US006606750B2

(12) United States Patent
Solwey

(10) Patent No.: US 6,606,750 B2
(45) Date of Patent: Aug. 19, 2003

(54) SOCK SYSTEM

(76) Inventor: Bernadine M. Solwey, 7899 Ephraim Hill Rd. East, St. Michael, ND (US) 58370-9008

( * ) Notice: Subject to any disclaimer, the term of this patent is extended or adjusted under 35 U.S.C. 154(b) by 0 days.

(21) Appl. No.: 10/053,438

(22) Filed: Jan. 16, 2002

(65) Prior Publication Data

US 2002/0095716 A1 Jul. 25, 2002

Related U.S. Application Data

(63) Continuation-in-part of application No. 09/642,874, filed on Aug. 21, 2000.

(51) Int. Cl.[7] ..... A41B 11/00
(52) U.S. Cl. ..... 2/239; 2/241; 66/185
(58) Field of Search ..... 2/239, 240, 241, 2/242, 61, 919, 409, 269; 66/185, 178 R, 182, 183, 186, 187, 179, 188; D2/980, 983, 993

(56) References Cited

U.S. PATENT DOCUMENTS 46,627 A * 3/1865 West ..... 241/261.1
268,734 A * 12/1882 Scott ..... 66/188
456,476 A * 7/1891 Cartledge ..... 66/185
653,398 A * 7/1900 Powell ..... 66/179
721,190 A 2/1903 Hirner
832,550 A * 10/1906 Lepper ..... 2/61
876,797 A * 1/1908 Gilbert ..... 2/239
1,708,342 A * 4/1929 Vogt ..... 2/239
2,613,520 A * 10/1952 Schaefer ..... 66/178 R
2,790,316 A * 4/1957 Palmer ..... 66/188
2,798,281 A * 7/1957 Herzog ..... 2/239
3,863,272 A * 2/1975 Guille ..... 2/239
3,887,946 A * 6/1975 Laskin et al. ..... 2/239
3,995,322 A * 12/1976 Chesebro, Jr. ..... 2/239
4,008,350 A * 2/1977 Crawford et al. ..... 521/54
4,255,819 A * 3/1981 Klingspor ..... 2/239
4,263,793 A * 4/1981 Safrit et al. ..... 66/185
4,277,959 A * 7/1981 Thorneburg ..... 66/182
4,341,096 A * 7/1982 Safrit et al. ..... 66/185
4,373,215 A * 2/1983 Guigley ..... 2/239
4,422,307 A * 12/1983 Thorneburg ..... 66/172 E (List continued on next page.)

*Primary Examiner*—John J. Calvert
*Assistant Examiner*—Alissa L. Hoey

(57) ABSTRACT

A sock system for assisting people who have problems with their feet sweating or that are diabetic. The inventive device includes a sock device having a top portion attached to a bottom portion by a connection means. The top portion may be comprised of any fabric or color desired by the user providing a pleasing visual appearance to the user. The bottom portion is comprised of a fluid absorbing material which is not colored such as terry cloth. The bottom portion is comprised of a bottom surface, a heel and a front upper portion. The front upper portion of the bottom portion preferably surrounds the entire portion of the toes of a user. The top portion is comprised of an upper end having an opening, a middle portion and a lower end wherein the lower end is attached to the bottom portion. The connection means is comprised of any connection structure commonly utilized to secure two pieces of fabric such as but not limited to glue or thread.

2 Claims, 2 Drawing Sheets

U.S. PATENT DOCUMENTS 4,520,635 A * 6/1985 Shields et al. ..... 66/185
4,615,188 A * 10/1986 Hursh et al. ..... 66/196
4,734,938 A * 4/1988 Anderson ..... 2/239
4,852,272 A * 8/1989 Chilewich et al. ..... 36/12
5,092,347 A * 3/1992 Shaffer et al. ..... 128/892
5,095,548 A * 3/1992 Chesebro, Jr. ..... 2/239
5,417,091 A * 5/1995 Moser ..... 66/178 R
5,509,282 A * 4/1996 Ferrell, Jr. ..... 66/188
5,724,836 A * 3/1998 Green ..... 66/185
5,740,559 A * 4/1998 Thiel ..... 2/239
5,778,702 A * 7/1998 Wrightenberry ..... 66/178 R
401,403 A * 11/1998 Schreiber ..... D2/980
5,926,852 A * 7/1999 Hudy ..... 2/239
5,946,731 A * 9/1999 Finlay et al. ..... 2/239
6,012,177 A * 1/2000 Cortinovis ..... 2/239
6,016,575 A * 1/2000 Prychak ..... 2/239
6,021,527 A * 2/2000 Lessard ..... 2/239
6,047,434 A * 4/2000 Falwell ..... 15/227
6,082,146 A * 7/2000 Dahlgren ..... 66/185
6,105,173 A * 8/2000 Brown ..... 2/239
6,158,253 A * 12/2000 Svoboda et al. ..... 66/178 R
6,292,951 B1 * 9/2001 Kalde ..... 2/239
6,308,337 B1 * 10/2001 Penley ..... 2/239
6,385,779 B2 * 5/2002 Boersema ..... 2/239

* cited by examiner

SOCK SYSTEM

CROSS-REFERENCE TO RELATED U.S. PATENT APPLICATION

I hereby claim benefit under Title 35, United States Code, Section 120 of U.S. patent application Ser. No. 09/642,874 filed Aug. 21, 2000. This application is a continuation-in-part of the Ser. No. 09/642,874 application. The Ser. No. 09/642,874 application is currently pending. The Ser. No. 09/642,874 application is hereby incorporated by reference into this application.

BACKGROUND OF THE INVENTION

1. Field of the Invention

The present invention relates generally to footwear and more specifically it relates to a sock system for people who have problems with their feet sweating or diabetic.

Individuals that have diabetes or similar problems must maintain their feet within a dry state without irritation to prevent infection. If infection should infiltrate the feet of the individual the individual may lose some of their toes or an entire foot. Individuals with diabetes therefore must be extremely careful when preparing their feet.

2. Description of the Prior Art

It can be appreciated that socks have been in use for years. Typically, conventional socks are comprised of material including dies and other chemicals that some individuals are extremely sensitive to. Diabetics have to be extremely careful not to wear socks that include dies or other chemicals because of the risk of irritation and infection. Some socks utilized by diabetics are the "Elk" wool/sportsman sock, the "Diabetic Comfort Socks", and the "Hunter" by Outlast.

The main problem with conventional socks is the fact of not having enough material to absorb the moisture from ones feet. Another problem with conventional socks is that they do not adequately absorb the moisture produced by the user's feet. Another problem with conventional socks is that the socks are colored thereby causing problems for diabetics.

Examples of patented footwear include U.S. Pat. No. 5,095,548 to Chesebro, Jr.; U.S. Pat. No. 5,417,091 to Moser; U.S. Pat. No. 1,708,342 to Vogt; U.S. Pat. No. 721,190 to Himer; U.S. Pat. No. 4,373,215 to Guigley; U.S. Pat. No. 1,431,643 to Fisher which are all illustrative of such prior art.

While these devices may be suitable for the particular purpose to which they address, they are not as suitable for people who have problems with there feet sweating and are/or diabetic. The main problem with conventional socks is the fact of not having enough material to absorb the moisture from ones feet. Another problem is the socks that do not absorb the moisture produced by the persons feet. Also, another problem is that conventional socks are not colored within the upper portions with white bottoms to avoid irritations and infections.

In these respects, the sock system according to the present invention substantially departs from the conventional concepts and designs of the prior art, and in so doing provides an apparatus primarily developed for the purpose of people who have problems with there feet sweating and are/or diabetic.

SUMMARY OF THE INVENTION

In view of the foregoing disadvantages inherent in the known types of socks now present in the prior art, the present invention provides a new sock system construction wherein the same can be utilized for people who have problems with there feet sweating and are/or diabetic.

The general purpose of the present invention, which will be described subsequently in greater detail, is to provide a new sock system that has many of the advantages of the socks mentioned heretofore and many novel features that result in a new sock system which is not anticipated, rendered obvious, suggested, or even implied by any of the prior art socks, either alone or in any combination thereof.

To attain this, the present invention generally comprises a sock device having a top portion attached to a bottom portion by a connection means. The top portion may be comprised of any fabric or color desired by the user providing a pleasing visual appearance to the user. The bottom portion is comprised of a fluid absorbing material which is not colored such as terry cloth. The bottom portion is comprised of a bottom surface, a heel and a front upper portion. The front upper portion of the bottom portion preferably surrounds the entire portion of the toes of a user. The top portion is comprised of an upper end having an opening, a middle portion and a lower end wherein the lower end is attached to the bottom portion. The connection means is comprised of any connection structure commonly utilized to secure two pieces of fabric such as but not limited to glue or thread.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a sock system that will overcome the shortcomings of the prior art devices.

An object of the present invention is to provide a sock system for people who have problems with there feet sweating and are/or diabetic.

Another object is to provide a sock system that absorbs the moisture from ones foot.

Another object is to provide a sock system that has no dies in the absorption area that could cause an infection.

Another object is to provide a sock system that reduces the risk of infection that could cause the loss of a toe or foot.

Another object is to provide a sock system that allows people with diabetes to wear colored socks with out jeopardizing their health.

Another object is to provide a sock system that allows the wearer to have colored socks that matches their outfit with out worrying about smelly feet.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
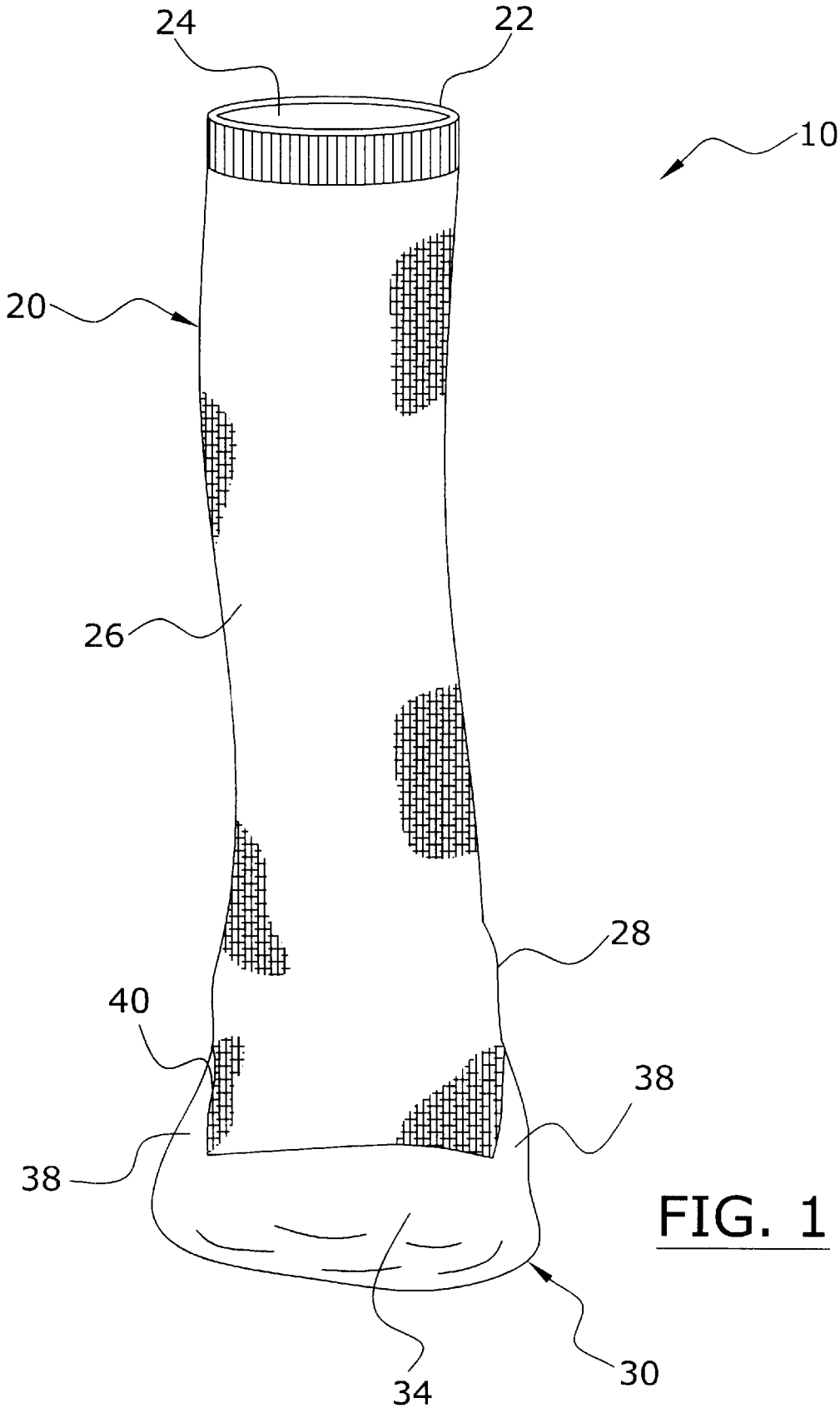
FIG. 1 is a front view of the present invention.

Turning now descriptively to the drawings, in which similar reference characters denote similar elements throughout the several views, the attached figures illustrate a sock system, which comprises a sock device having a top portion 20 attached to a bottom portion 30 by a connection means 40. The top portion 20 may be comprised of any fabric or color desired by the user providing a pleasing visual appearance to the user. The bottom portion 30 is comprised of a fluid absorbing material that is not colored such as terry cloth. The bottom portion 30 is comprised of a bottom surface 32, a heel 36 and a front upper portion 34. The front upper portion 34 of the bottom portion 30 preferably surrounds the entire portion of the toes of a user. The top portion 20 is comprised of an upper end 22 having an opening 24, a middle portion 26 and a lower end 28 wherein the lower end 28 is attached to the bottom portion 30. The connection means 40 is comprised of any connection structure commonly utilized to secure two pieces of fabric such as but not limited to glue or thread.

Figure 2:
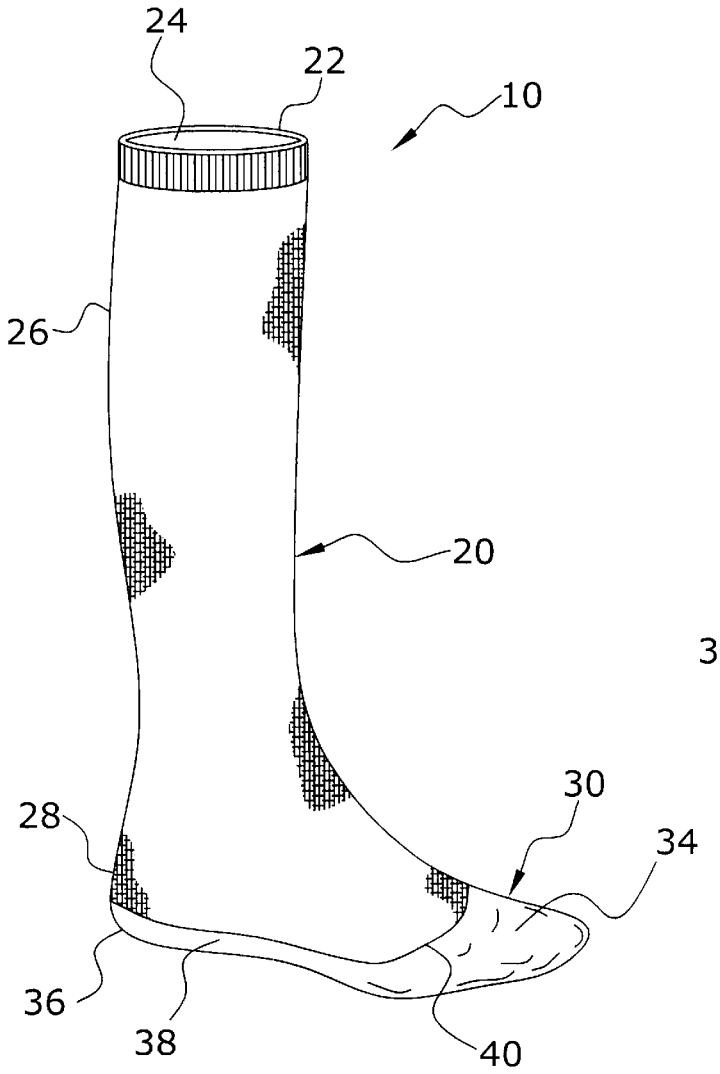
FIG. 2 is a left side view of the present invention.

As shown in FIGS. 1 and 2 of the drawings, the top portion 20 of the sock system 10 runs from the ankle of the user to the top of the sock. The top part of the sock can be any color and can be in many different styles including crew socks, tube socks, anklets, and casual socks.

The opening 24 of the top portion 20 is formed for receiving the foot and leg of a user without significantly interfering with the wearing of the sock system 10. The lower end 28 of the sock system 10 is formed for receiving the bottom portion 30 as shown in FIGS. 1 and 2 of the drawings. The upper surface of the top portion 20 extends into the bottom portion 30 a finite distance as best shown in FIGS. 1 and 2 of the drawings.

Figure 3:
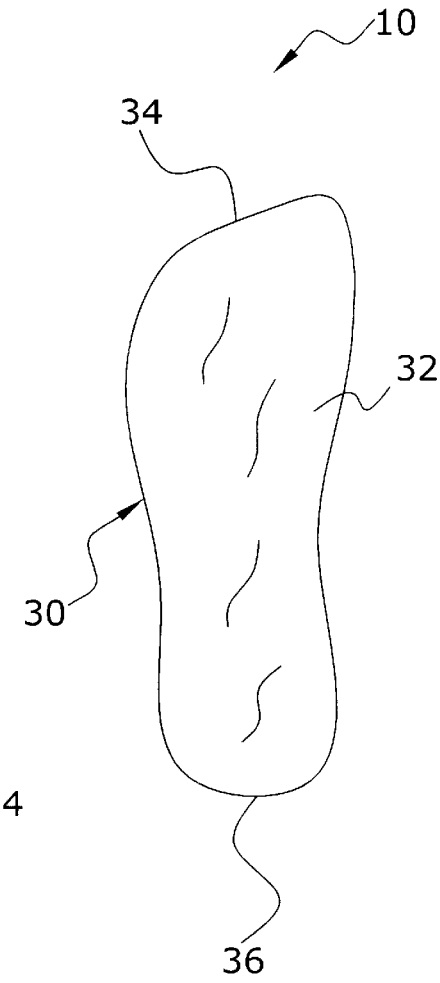
FIG. 3 is a bottom view of the present invention.

As shown in FIGS. 1 through 3 of the drawings, the bottom portion 30 extends from the ankle to the toes and heel of the foot of the user. The bottom portion 30 runs from the heel to the toes while also wrapping around the bottom of the foot from one ankle to the other. The bottom portion 30 is made out of non-colored terry cloth on the inner sole and shell for absorbing perspiration from the user's foot.

As shown in FIGS. 1 through 3 of the drawings, the bottom portion 30 is comprised of a bottom surface 32 extending the entire length of the user's foot including a heel 36, and a front upper portion 34 surrounding the toes of the user. A side wall 38 of the bottom portion 30 preferably extends upwardly upon the sides of the user's foot less than one inch as best shown in FIGS. 1 and 2 of the drawings. The front upper portion 34 extends from opposing sides and the front of the side wall 38 to cover a plurality of toes of the user's foot. The front upper portion 34 extends horizontally rearwardly from the front of the side wall 38 a distance of at least 10 percent of a length of the bottom portion and less than 30 percent of the length of the bottom portion.

As shown in FIGS. 1 through 2 of the drawings, the top portion 20 is connected with the bottom portion 30 with a connection means 40. The connection means 40 may be comprised of any well-known connecting structure such as glue or thread to retain the top portion 20 in connection with the bottom portion 30.

The top portion 20 of the sock system 10 may be comprised of any color or fabric. The style of the sock can be comprised of, but not limited to, any of the following: crew socks, sports socks, casual socks, anklets, slouch socks, tube socks, boot socks, hunting socks. The sock can be made in men's, women's and children's sizes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

| Index of Elements for Sock System |
|---|
| ☐ ENVIRONMENTAL ELEMENTS |
| ☐ |
| ☐ |
| ☐ |
| ☐ |
| ☐ |
| ☐ |
| ☐ |
| ☐ |
| ☐ |
| ☐ 10. Sock System |
| ☐ 11. |
| ☐ 12. |
| ☐ 13. |
| ☐ 14. |
| ☐ 15. |
| ☐ 16. |
| ☐ 17. |
| ☐ 18. |
| ☐ 19. |
| ☐ 20. Top Portion |
| ☐ 21. |
| ☐ 22. Upper End |
| ☐ 23. |
| ☐ 24. Opening |
| ☐ 25. |
| ☐ 26. Middle Portion |
| ☐ 27. |
| ☐ 28. Lower End |
| ☐ 29. |

-continued

| Index of Elements for Sock System |
|---|
| ☐ 30. Bottom Portion |
| ☐ 31. |
| ☐ 32. Bottom Surface |
| ☐ 33. |
| ☐ 34. Front Upper Portion |
| ☐ 35. |
| ☐ 36. Heel |
| ☐ 37. |
| ☐ 38. Side Wall |
| ☐ 39. |
| ☐ 40. Connection Means |
| ☐ 41. |
| ☐ 42. |
| ☐ 43. |
| ☐ 44. |
| ☐ 45. |
| ☐ 46. |
| ☐ 47. |
| ☐ 48. |
| ☐ 49. |
| ☐ 50. |
| ☐ 51. |
| ☐ 52. |
| ☐ 53. |
| ☐ 54. |
| ☐ 55. |
| ☐ 56. |
| ☐ 57. |
| ☐ 58. |
| ☐ 59. |
| ☐ 60. |
| ☐ 61. |
| ☐ 62. |
| ☐ 63. |
| ☐ 64. |
| ☐ 65. |
| ☐ 66. |
| ☐ 67. |
| ☐ 68. |
| ☐ 69. |
| ☐ 70. |
| ☐ 71. |
| ☐ 72. |

-continued

| Index of Elements for Sock System |
|---|
| ☐ 73. |
| ☐ 74. |
| ☐ 75. |
| ☐ 76. |
| ☐ 77. |
| ☐ 78. |
| ☐ 79. |

I claim:

1. A Sock System, comprising:

a top portion, wherein said top portion includes an upper opening for receiving said foot of said user and wherein said top portion is colored;

a bottom portion permanently attached to said top portion, wherein said bottom portion is constructed of a fluid absorbing non-colored textile material; and wherein said bottom portion is comprised of:

a bottom surface that extends an entire length of a lower surface of a foot of a user;

a side wall that extends upwardly from said bottom surface from a rear through the sides of said foot of said user to a front of said bottom surface, wherein said side wall extends upwardly less than one inch; and a front upper portion that extends from opposing sides and said front of said side wall to cover a plurality of toes of said foot, wherein said front upper portion horizontally extends rearwardly from said front of said side wall a distance of at least 10 percent of a length of said bottom portion and less than 30 percent of said length of said bottom portion.

2. The Sock System of claim 1, wherein said bottom portion is comprised of terry cloth.

* * * * *